US005201098A

United States Patent [19]

Egerer

[11] Patent Number: 5,201,098

[45] Date of Patent: Apr. 13, 1993

[54] NEEDLE BAR CARRIER

[75] Inventor: Josef Egerer, Schwabach, Fed. Rep. of Germany

[73] Assignee: Staedtler & Uhl, Schwabach, Fed. Rep. of Germany

[21] Appl. No.: 773,805

[22] Filed: Oct. 9, 1991

[30] Foreign Application Priority Data

Oct. 19, 1990 [DE] Fed. Rep. of Germany ..... 4033262

[51] Int. Cl.[5] ..... D01G 19/10

[52] U.S. Cl. ..... 19/129 R

[58] Field of Search ..... 19/129 R, 220, 0.6; 26/96; 28/115, 299; 66/114; 112/80.45

[56] References Cited

U.S. PATENT DOCUMENTS

| | | | |
|---|---|---|---|
| 2,860,381 | 11/1958 | Spisak | 19/129 R |
| 3,057,021 | 10/1962 | Hill | 19/129 R |
| 3,156,951 | 11/1964 | Herubel | 19/129 R |
| 3,699,643 | 10/1972 | Isumi | 19/129 R |
| 4,266,327 | 5/1981 | Egerer | 19/129 R |

FOREIGN PATENT DOCUMENTS

| | | | |
|---|---|---|---|
| 2909525 | 6/1982 | Fed. Rep. of Germany . | |
| 8128217 | 4/1984 | Fed. Rep. of Germany . | |
| 3336326 | 4/1985 | Fed. Rep. of Germany . | |
| 620327 | 5/1961 | Italy | 19/129 R |
| 736163 | 9/1955 | United Kingdom | 19/129 R |
| 919873 | 2/1963 | United Kingdom | 19/129 R |
| 1400989 | 7/1975 | United Kingdom | 19/129 R |
| 2084054 | 4/1982 | United Kingdom | 19/129 R |

*Primary Examiner*—Clifford D. Crowder
*Assistant Examiner*—Michael A. Neas
*Attorney, Agent, or Firm*—Browdy and Neimark

[57] ABSTRACT

In a needle bar carrier with a needle bar comprising a plurality of needles anchored in a plastic bar, the needle bar being attachable to the needle bar carrier by form locking and for the purpose of achieving a very stable connection between the needle bar and the needle bar carrier along with a simple and defined release it is provided that the plastic bar is arrested in holes of the needle bar carrier by the plastic material of the plastic bar being thermally or chemically joined by solving or melting while forming a projection extending into or beyond the hole.

1 Claim, 2 Drawing Sheets

FIG. 2
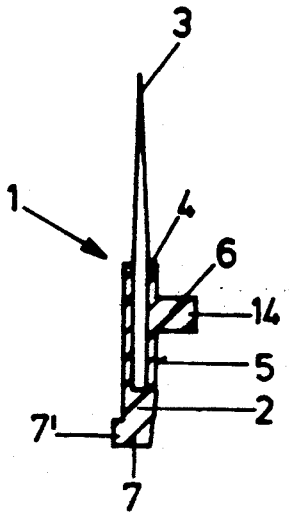
FIG. 1
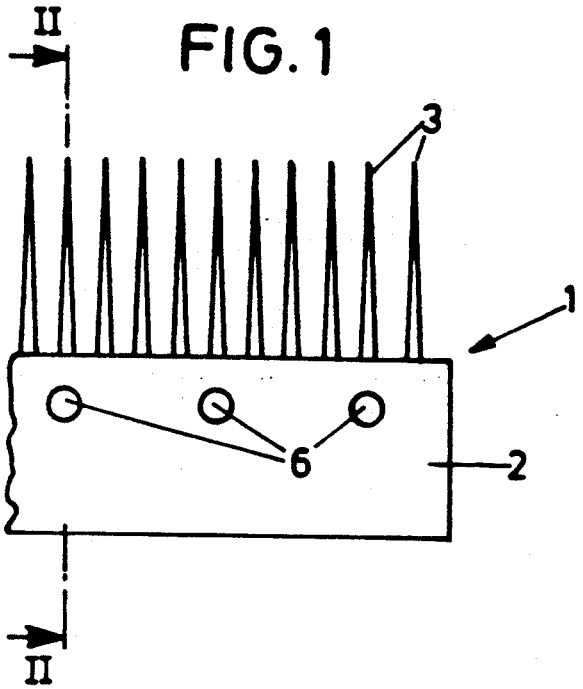
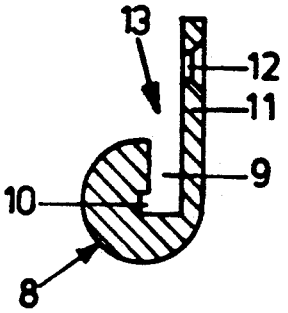
FIG. 3
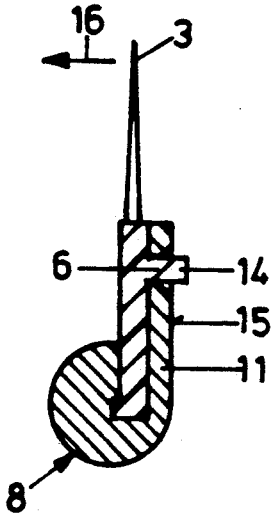
FIG. 4
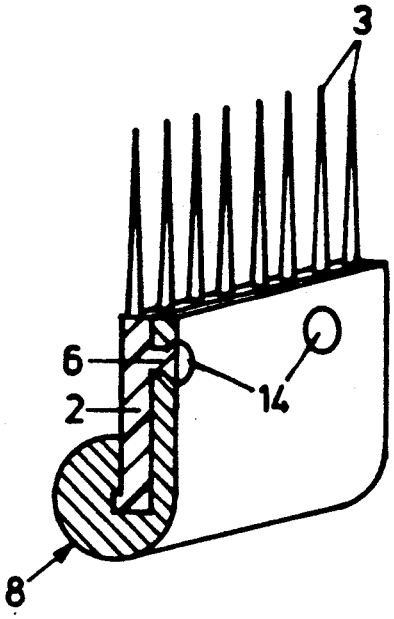
FIG. 5

FIG. 6
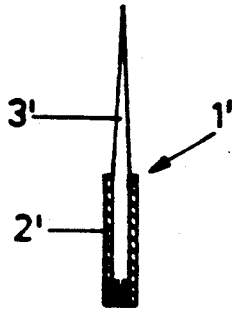
FIG. 7
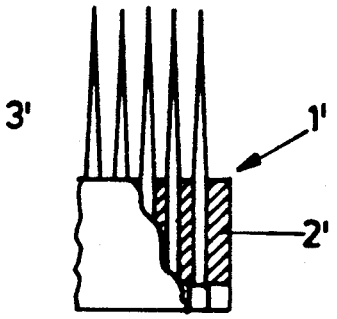
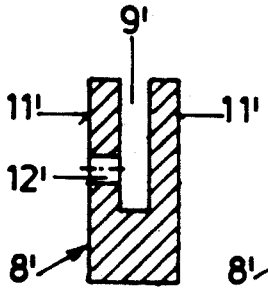
FIG. 10
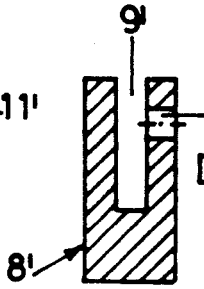
FIG. 9
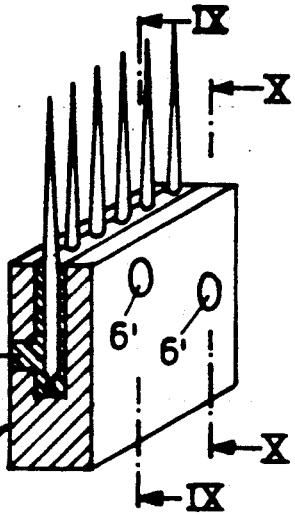
FIG. 8
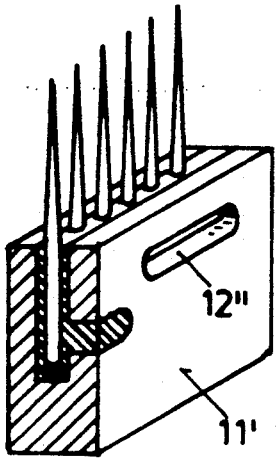
FIG. 11
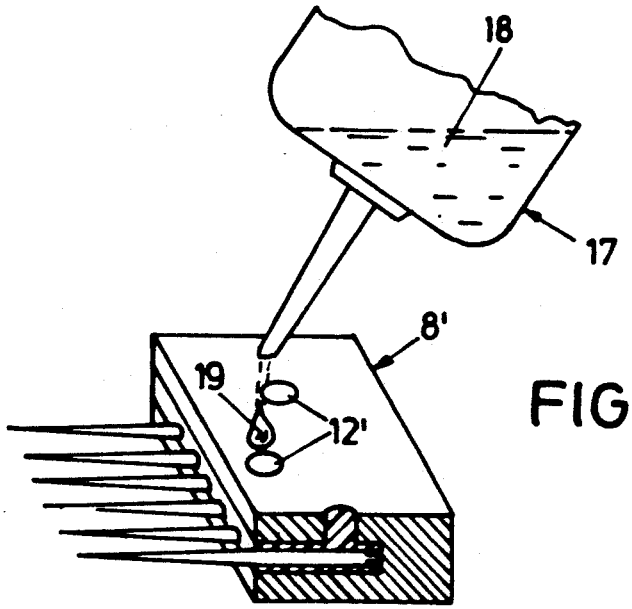
FIG. 12

NEEDLE BAR CARRIER

FIELD OF THE INVENTION

The invention relates to a needle bar carrier for textile machinery, in particular for combing machines, open-end spinning machines as well as intersecting machines with a needle bar comprising a plurality of needles anchored in a plastic bar, the needle bar being attachable to the needle bar carrier by form locking.

BACKGROUND OF THE INVENTION

The needles of the needle bars of textile machines of the generic kind are subject to wear during operation or they may break off. Therefore it is necessary to replace the needle bars after a certain time of operation. Consequently, such needle bars must be connected with the needle bar carrier in a manner easy to insert and easy to release, on the other hand it must be ensured during operation that the needle bars are absolutely safely arrested in the needle bar carrier.

Various arresting techniques have been developed to this effect. It is known in particular to arrest needle bars with a metal root in the needle bar carrier or in a longitudinal groove of the latter by soldering. Furthermore, arresting by way of an adhesive has been disclosed. Other solutions teach to provide the side walls of the needle bar root with burllike projections, so that the needle bars can be inserted into corresponding grooves of the needle bar carrier in the way of a slide-lock.

These prior art solutions are of disadvantage because they are neither easy to handle nor ensure sufficiently reliable arresting, nor can they be used for needle bars with a root formed by a plastic bar.

SUMMARY OF THE INVENTION

It is accordingly the object of the invention to embody needle bars with a plastic bar such that they can easily and reliably be arrested in and released from a needle bar carrier, in particular of metal.

In accordance with the invention this object is attained in that the plastic bar is arrested in holes of the needle bar carrier by the plastic material of the plastic bar being thermally of chemically joined by solving or melting while forming a projection extending into or beyond the hole to thereby unite the plastic bar to the needle bar carrier.

The invention is based on the idea of combining an attachment of purely mechanical form locking with an attachment by chemical or thermal deformation of the plastic bar with, as a result of the basic connection by form locking, a slight deformation of the plastic bar being sufficient to achieve an extraordinarily reliable arresting of the needle bar and with such a slight deformation being in turn easy to redress.

In a first embodiment it can advantageously be provided that the plastic bar has lateral projections passing through corresponding holes of the needle bar carrier by lateral form locking, their free ends exiting on the outside of the holes being deformed thermally or chemically thus forming a retaining head overlapping the rims of the hole.

As a result of the connection by form locking the needle bars are arrested in radial direction, i.e. in the direction of the centrifugal force acting upon the needle bar during operation, in this embodiment. The thermal or chemical deformation of the lateral projections additionally serves to ensure absolutely reliable arresting even in tangential direction against forces that act upon the needle bar in a direction opposite the direction of combing.

Advantageously the free ends of the projections can be deformed by being passed over with a heating bar or a heating pistol.

A needle bar thus arrested can be released without any problems by splitting of the retaining heads, for instance by drilling.

To achieve an even better attachment by form locking it can be provided in an embodiment that the needle bar carrier is substantially J-shaped in cross-section, that a retaining groove for the needle bars is formed inside the J-profile, that at least sections of the bottom of the retaining grooves have recesses, and that at least in sections of the plastic bar root of the needle bar corresponding locking shoulders are arranged. This embodiment is particularly suitable for chain drawing equipment.

In a further embodiment particularly suitable for cam-actuated intersecting machines it can be provided that the needle bar carrier is U-shaped in cross-section, that the plastic bar of the needle bar is inserted into the inside of the U-profile serving as a retaining groove, that the side walls of the plastic bar are essentially smooth and that the side walls of the plastic bar are chemically or thermally joined by melting or solving through holes of the U-profile.

In particular, it can advantageously be provided that plastic bolts are melted onto the plastic bars of the needle bars from outside through the holes of the needle bar carrier to arrest the needle bar.

Alternately it can be provided that a solvent is applied through the holes solving the plastic material of the plastic bar for joining. It is the effect of such a solvent that the plastic bar is initially solved and swells up so that the rim of the holes is gripped by the swollen-up plastic material.

In this embodiment, too, the release of the needle bar can be realized by mechanical splitting, for instance by drilling.

Further details of the invention will become apparent from the ensuing description of examples of embodiment taken in conjunction with the drawing.

BRIEF DESCRIPTION OF THE DRAWING

FIG. 1 is a partial side view of a first embodiment of a needle bar,

FIG. 2 is a section along the line II—II in FIG. 1,

FIG. 3 is a section through a needle bar carrier without a needle bar inserted,

FIG. 4 is a representation corresponding to FIG. 3 with a needle bar inserted,

FIG. 5 is a perspective representation corresponding to FIG. 4,

FIG. 6 is a section through a further embodiment of a needle bar,

FIG. 7 is a lateral view of the embodiment according to FIG. 6 is an illustration partially broken open, FIG. 8 is a perspective view of a further embodiment of a needle bar carrier with an inserted needle bar according to FIG. 6, FIG. 9 is a section along the line IX—IX in FIG. 8 without an inserted needle bar, FIG. 10 is a section along the line X—X in FIG. 8 without an inserted needle bar, FIG. 11 is a perspective representation of a needle bar carrier with a needle bar inserted according to a modified embodiment, and FIG. 12 is a perspective view of the needle bar carrier with needle bar according to FIG. 8 illustrating the arresting by solving.

DESCRIPTION OF THE PREFERRED EMBODIMENTS

FIG. 1 to 5 show an embodiment as it is suitable for instance for chain drawing equipment.

FIGS. 1 and 2 show a needle bar 1 comprising a plastic bar 2 and a plurality of needles 3 which are inserted into a groove 4 of U-shaped cross-section of the plastic bar 2. The anchoring of the needles 3 can be made mechanically or in that they are surrounded by the plastic bar 2 by extrusion.

A plurality of pin-shaped projections 6 is integrally formed on one side wall 5 of the plastic bar 2. A web-like locking shoulder 7' extending longitudinally is integrally formed at the root 7 of the needle bar 1 on the side facing away from the projections 6.

FIGS. 3 to 5 show a needle bar carrier 8 of J-shaped cross-section in the embodiment. A retaining groove 9 is formed on the inside of the J, with a recess 10 extending at the foot of the retaining groove 9 and corresponding in cross-section approximately to the locking shoulder 7'. A plurality of holes 12 extend through the section 11 directed upwards of the needle bar carrier 8 and correspond in diameter and location to the projections 6. Consequently, the plastic bar 2 of the needle bar 1 can be inserted into the groove 9 in an oblique direction according to the arrow 13 in FIG. 3, the locking shoulders 7' entering into the recess 10 and the projections 6 passing through the holes 12, so that—as seen in FIG. 4—the free outer ends 14 of the projections 6 slightly protrude from the outside 15 of the wall section 11. The wall section 11 fully supports the needle bar 1 in the area of the plastic bar 2, when the needles 3 engage in the material to be combed in the direction of combing (arrow 16).

In addition to the attachment by form locking as described above further arresting is achieved in that the free ends 14 of the projections 6 are melted with a heating bar or a heating pistol, so that this end 14 is spread like a rivet overlapping the rim of the holes 12. In spite of only a slight deformation of the projections 6 thus resulting, the combination with the attachment by form locking serves on the whole to achieve excellent arresting of the needle bar 1 on the needle bar carrier 8. To release the needle bar 1 it is only necessary to remove the head produced by melting at the free end 14 of the projections 6 by means of a drilling or grinding machine.

The embodiment shown in FIGS. 6 to 12 can be used for instance for cam-driven drawing equipment.

A needle bar 1' is illustrated in FIG. 6 of which the root part is in the form of a plastic bar 2', the needles 3' being mechanically arrested on the plastic bar 2'.

A needle bar carrier 8' illustrated in FIGS. 8 to 10 is U-shaped in cross-section, a retaining groove 9' inside the U-profile serving to receive the plastic bar 2'. The plastic bar 2' of a needle bar 1' is pressed into this groove 9' by form locking as shown in FIG. 8.

The side walls 11' of the needle bar carrier 8' have holes 12'. To arrest a needle bar 1' in a needle bar carrier 8' bolt-shaped plastic parts 6' are melted by means of a heating pistol not shown in the drawing and put through the holes 12' in molten state, so that the plastic material of the plastic bar 2' of the needle bar 1' is melted and bonds with the plastic parts 6'. Consequently, the plastic parts 6' will preferably be chosen to consist of a plastic material that corresponds to the plastic material of the plastic bar 2' or that is at least chemically similar so that the two plastic materials bond.

In the variant shown in FIG. 11 the side wall 11' of the needle bar carrier 8' has one or several oblong holes 12'' instead of a plurality of circular holes 12'. In this embodiment arresting can take place in such a way that the plastic bar 2' is directly melted through the oblong hole 12'' by means of a sort of a soldering iron or pistol so that it partially engages with the hole 12'', that it is chemically joined by solving by means of a solvent, or—as outlined in connection with FIGS. 8 to 10—that molten plastic parts are used as a sort of locking bolts.

FIG. 12 illustrates how the arresting of a needle bar 1' in a needle bar carrier 8' can take simply take place in a chemical way, by a solvent 18 in the form of drops 19 being applied by means of a dosing device 17 into the lateral holes 12' and solving the plastic material of the plastic bar 2' so that it joins. If for instance polystyrene is used as a plastic material for the plastic bar 2', a benzol-based or toluene-based solvent is suitable. Tests have shown that excellent arresting forces are achieved with such a combination of material. Nevertheless, a connection thus produced can be released simply by drilling, milling or grinding.

What is claimed is:

1. A needle bar carrier with a needle bar, said needle bar comprising a plurality of needles anchored in a plastic bar, said needle bar carrier comprising a plurality of holes, said plastic bar being united by form locking to said needle bar carrier by having projections thereof extending at least partway into said holes, said needle bar carrier being substantially J-shaped in cross-section to define a retaining groove for said needle bar inside said J-shaped configuration, said retaining groove having a plurality of recesses, said plastic bar having a plurality of locking shoulder corresponding with and being retained within said plurality of recesses.

* * * * *